US012643000B2

(12) United States Patent
Zhou et al.

(10) Patent No.: US 12,643,000 B2
(45) Date of Patent: Jun. 2, 2026

(54) ALL-IN-ONE MACHINE FOR LEG EXTENSION AND FLEXION

(71) Applicant: GMWD INC, Bellevue, WA (US)

(72) Inventors: Bo Zhou, Zhejiang (CN); Fanrui Meng, Shandong (CN)

(73) Assignee: GMWD INC, Bellevue, WA (US)

( * ) Notice: Subject to any disclaimer, the term of this patent is extended or adjusted under 35 U.S.C. 154(b) by 0 days.

(21) Appl. No.: 19/299,286

(22) Filed: Aug. 13, 2025

(65) Prior Publication Data

US 2026/0000930 A1 Jan. 1, 2026

(30) Foreign Application Priority Data

Jun. 27, 2024 (CN) ..... 202430397101.1

(51) Int. Cl.

*A63B 21/06* (2006.01)
*A63B 21/00* (2006.01)
*A63B 23/04* (2006.01)

(52) U.S. Cl.

CPC ..... *A63B 21/0615* (2013.01); *A63B 21/4031* (2015.10); *A63B 23/0494* (2013.01); *A63B 2208/0233* (2013.01)

(58) Field of Classification Search

CPC . A63B 21/06; A63B 21/0615; A63B 21/0616; A63B 21/0617; A63B 21/4031; A63B 21/4045; A63B 21/4047; A63B 23/03516; A63B 23/03525; A63B 23/0494; A63B 2208/0233

See application file for complete search history.

(56) References Cited

U.S. PATENT DOCUMENTS 2,855,199 A * 10/1958 Noland ..... A63B 21/4047 601/24
4,502,681 A * 3/1985 Blomqvist ..... A63B 23/03516 482/130
5,484,365 A * 1/1996 Jones ..... A63B 23/0488 482/137
7,691,038 B2 * 4/2010 Shearer ..... A63B 21/00072 482/130
12,303,739 B1 * 5/2025 Nolan ..... A63B 21/4047
12,318,657 B1 * 6/2025 Nolan ..... A63B 17/04
2007/0254787 A1 * 11/2007 Matsubara ..... A63B 21/0058 482/92
2017/0319905 A1 * 11/2017 O'Connor ..... A63B 21/00181

FOREIGN PATENT DOCUMENTS

CN 219896924 U * 10/2023
CN 117771610 A * 3/2024
WO WO-2023163728 A1 * 8/2023 ..... A63B 17/04

* cited by examiner

*Primary Examiner* — Gary D Urbiel Goldner
(74) *Attorney, Agent, or Firm* — Hawaii Patent Services; Nathaniel K. Fedde; Kenton N. Fedde

(57) ABSTRACT

The present disclosure relates to an all-in-one machine for leg extension and flexion, comprising: a body and a swinging mechanism; and a weight assembly, mounted on the body and operably linked with the swinging mechanism; wherein the weight assembly comprises a connecting arm rotationally connected to the body, the connecting arm is provided with an orientation part along its length direction, a weight arm is mounted on the orientation part, and the weight arm is capable of reciprocally sliding along the orientation part and rotating around the orientation part.

20 Claims, 17 Drawing Sheets

ALL-IN-ONE MACHINE FOR LEG EXTENSION AND FLEXION

CROSS-REFERENCE TO RELATED APPLICATIONS

This application claims priority to Chinese Design Patent Application Ser. No. 202430397101.1, titled "All-in-one machine for leg extension and flexion in Sitting and Lying gestures" filed on Jun. 27, 2024, the content of which, including the amendments thereof, is incorporated herein by reference in its entirety.

TECHNICAL FIELD

The present disclosure relates to the technical field of fitness equipment, particularly to an all-in-one machine for leg extension and flexion.

BACKGROUND

With the improvement of living standards and increased health awareness, fitness equipment has become widely used in daily life. However, existing fitness equipment, such as leg press machines, has some shortcomings in their weight systems.

Existing technologies, such as U.S. Pat. Nos. 7,691,038 and 5,484,365, propose fitness equipment related to leg extension and flexion exercises. However, these solutions have certain drawbacks: users need to purchase a plurality of specifications of weight plates to meet different intensity requirements, resulting in high costs and inconvenient storage. Weight adjustment relies on removing or stacking fixed-weight plates, which is cumbersome and labor-intensive. Moreover, weight adjustment can only be achieved by changing the weight plate's resistance level, offering poor flexibility and preventing continuous or fine-tuned resistance adjustments, thereby affecting training adaptability and efficiency.

SUMMARY

The present disclosure provides an all-in-one machine for leg extension and flexion to address the issues raised in the background art.

An all-in-one machine for leg extension and flexion comprises a body; a swinging mechanism, mounted on the body; and a weight assembly, mounted on the body and operably linked with the swinging mechanism. The weight assembly comprises a connecting arm rotationally connected to the body, the connecting arm is provided with an orientation part along a length direction thereof, and a weight arm is mounted on the orientation part. The weight arm is capable of reciprocally sliding along the orientation part and rotating the around the orientation part, the connecting arm is provided with a plurality of first clamping parts, and the weight arm is provided with a second clamping part matching the first clamping parts. The second clamping parts are selectively engaged with any of the first clamping parts to restrict sliding of the weight arm.

An all-in-one machine for leg extension and flexion comprises a body and a swinging mechanism. The body is provided with a weight assembly that is operably linked to the swinging mechanism. The weight assembly comprises a connecting arm rotationally connected to the body, the connecting arm is provided with an orientation part arranged along a length direction thereof, and the orientation part is equipped with a weight arm capable of sliding reciprocally along the orientation part. The connecting arm is provided with a plurality of first clamping parts, the weight arm is provided with a second clamping part matching the first clamping parts, and the second clamping part is capable of being selectively engaged with any of the first clamping parts to restrict sliding of the weight arm.

An all-in-one machine for leg extension and flexion comprises a body and a swinging mechanism. The body is provided with a weight assembly that is operably linked to the swinging mechanism. The weight assembly comprises a connecting arm rotationally connected to the body, the connecting arm is provided with an orientation part arranged along a length direction thereof, and the orientation part is equipped with a weight arm capable of sliding reciprocally along the orientation part. The connecting arm is provided with a first clamping part, the weight arm is provided with a second clamping part matching the first clamping part, and the second clamping part is capable of being selectively engaged with any position of the first clamping part to achieve locking and restrict sliding of the weight arm.

To achieve the above inventive objective, the present disclosure adopts the following technical solutions:

By arranging a guide sliding rod on the connecting arm, the weight arm can slide reciprocally along the guide sliding rod, dynamically adjusting the counter-torque of the weight arm using the lever principle. When the weight arm is far from the pivot end of the connecting arm and the body, the counter-torque is maximized, and it gradually decreases otherwise, enabling continuous switching of different resistance intensities. Users can precisely adjust training resistance without adding or removing weight plates; the multi-gear fixed adjustment is achieved through the clamping structure between the weight arm and the connecting arm. Users only need to rotate the weight arm to quickly unlock/lock, offering convenient operation and high stability, preventing accidental sliding during exercise and improving training efficiency.

BRIEF DESCRIPTION OF DRAWINGS

The drawings, which form part of this application, are intended to provide further understanding of the disclosure. The illustrative embodiments and the descriptions thereof serve to explain the disclosure and do not constitute undue limitations thereof. In the drawings.

Figure 1:
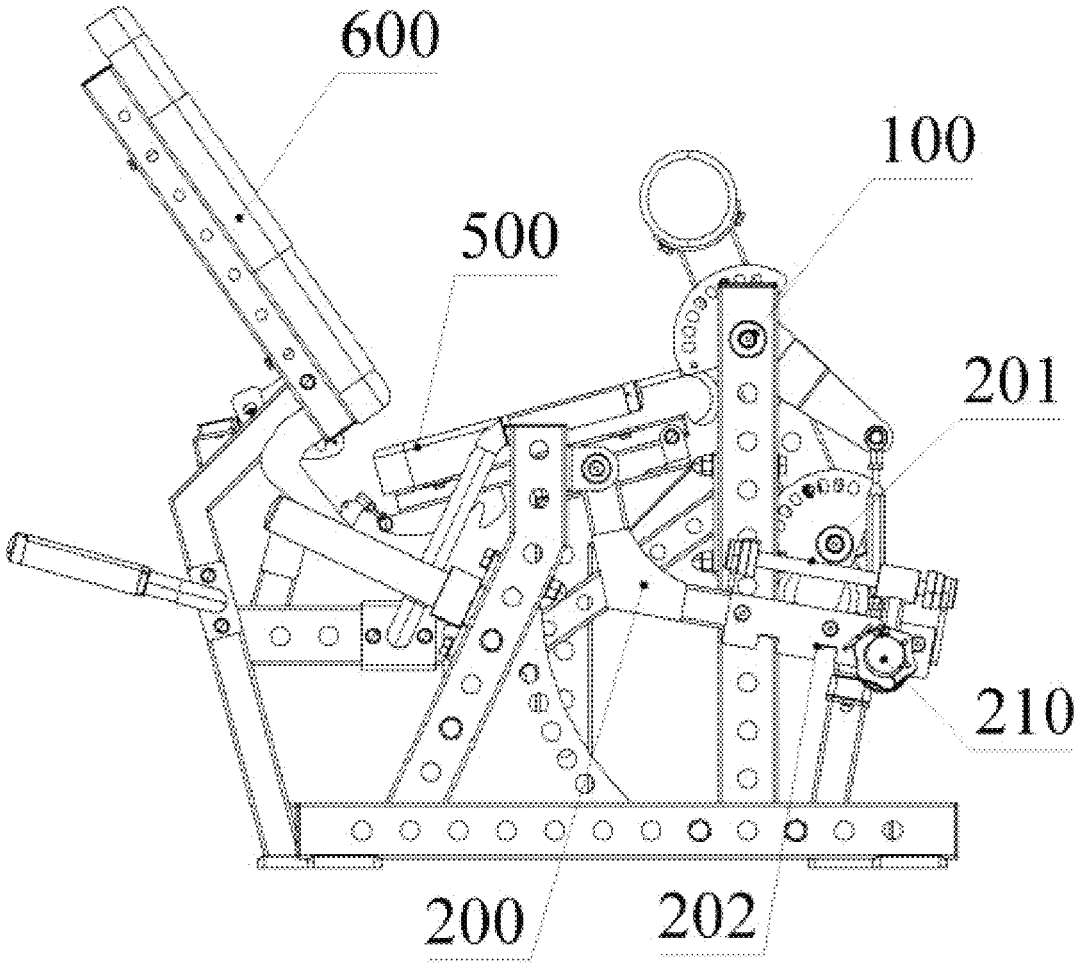
FIG. 1 is a schematic structural view of the disclosure.

Reference signs: Body (100); Connecting arm (200); Guide sliding rod (201); Clamping groove (202); Weight arm (210); Clamping post (211); First link rod (300); First adjustment disc (301); First insertion hole (3011); Second link rod (310); First gear lever (311); Second gear lever (312); Swing crossbar (320); Second adjustment disc (321); Second insertion hole (3211); Traction rod (400); Seat cushion (500); Guide part (510); Arc-shaped guiding surface (511); Positioning groove (512); Connecting rod (513); Back cushion (600); Lever part (610); Lever (611); First locking pin (612); Cushion body (620); Sliding rod (621); Positioning member (622); Second locking hole (623); Bracket (630); Mounting base (631); Second locking pin (640); Stop member (700); Pressing block (710); First locking plate (800); First locking hole (810); Through slot (900); Locking member (910).

DESCRIPTION OF EMBODIMENTS

The technical solution in the embodiment of the present disclosure will be clearly and completely described below with reference to the drawings. Obviously, the described embodiment is part of, rather than all of the embodiments of the present disclosure. The following description of at least one exemplary embodiment is illustrative in nature and is in no way intended to limit the present disclosure, its application or uses. Based on the embodiments in the present disclosure, all other embodiments obtained by those skilled in the art without creative work belong to the scope of protection of the present disclosure.

It should be noted that the terminology used here is only for describing specific embodiments, and is not intended to limit exemplary embodiments according to the present application. As used herein, the singular form is also intended to include the plural form unless the context clearly indicates otherwise. Furthermore, it should be appreciated that when the terms "comprising" and/or "including" are used in this specification, they specify the presence of features, steps, operations, devices, components and/or combinations thereof.

Unless otherwise specified, the relative arrangement of components and steps, numerical expressions and numerical values set forth in these embodiments do not limit the scope of the present disclosure. At the same time, it should be appreciated that for the convenience of description, the dimensions of various parts shown in the drawings are not drawn according to the actual scale relationship. Techniques, methods and equipment known to those skilled in the art may not be discussed in detail, but in appropriate cases, they should be regarded as part of the authorization specification. In all the examples shown and discussed herein, any specific values should be interpreted as illustrative, and not as limiting. Therefore, other examples of exemplary embodiments may have different values. It should be noted that similar numbers and letters indicate similar items in the following drawings, therefore once an item is defined in one drawing, it does not need to be further discussed in subsequent drawings.

As shown in FIGS. 1 to 8, an all-in-one machine for leg extension and flexion includes a body 100 and a swinging mechanism. The body 100 is provided with a weight assembly, which is operably linked to the swinging mechanism. The weight assembly includes a connecting arm 200 rotatably connected to the body 100. The connecting arm 200 has an orientation part along its length, on which a weight arm 210 is mounted. The weight arm 210 can slide reciprocally along the orientation part and rotate relative to it. The connecting arm 200 is provided with a plurality of first clamping parts, while the weight arm 210 has second clamping parts that is engaged with the first clamping parts. The second clamping parts can be selectively engaged with any of the first clamping parts to restrict the sliding of the weight arm 210.

Figure 2:
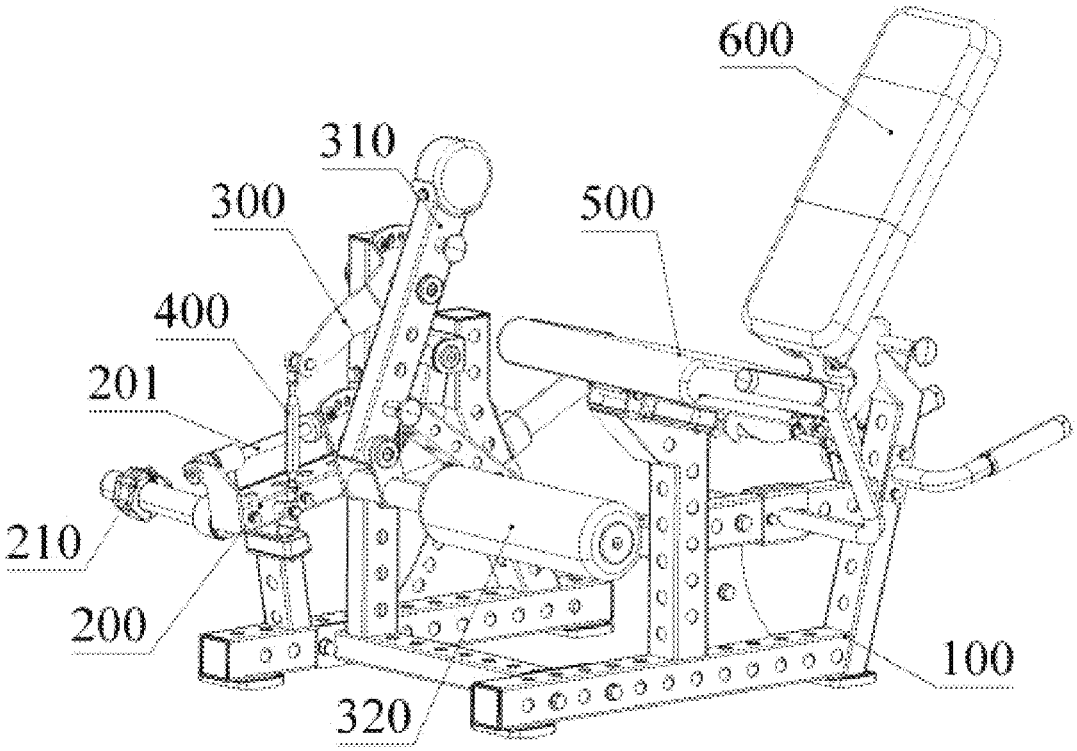
FIG. 2 is a schematic structural view of the disclosure from another perspective.
Figure 3:
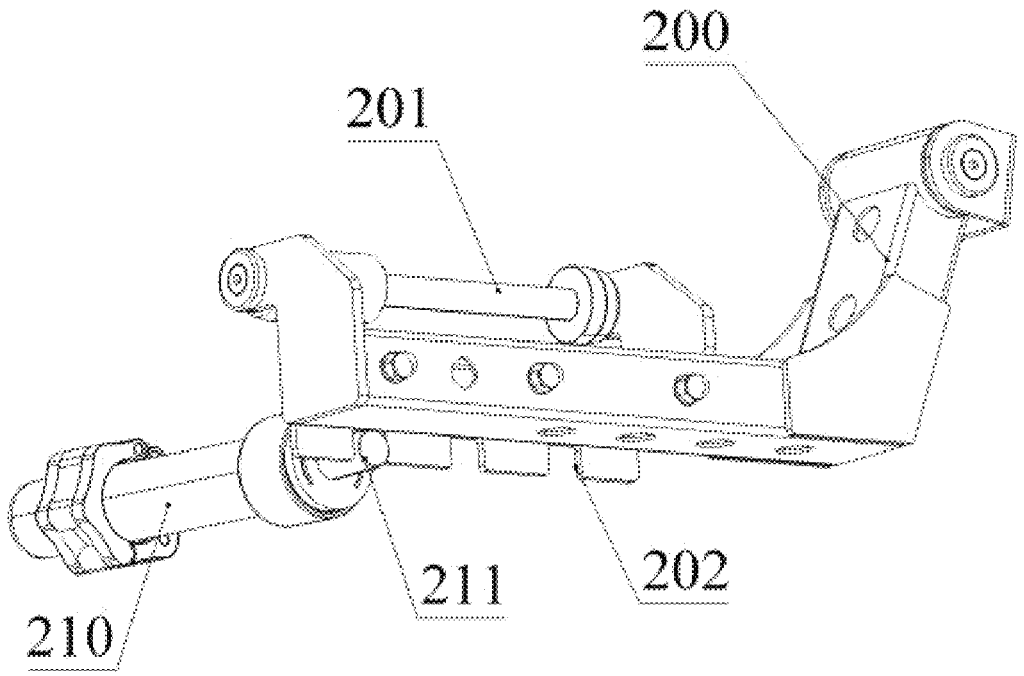
FIG. 3 is a schematic structural view of the weight assembly of the disclosure.

Referring to FIGS. 1 to 3, in this embodiment, the weight arm 210 generates a counter-torque due to gravity. By adjusting the position of the weight arm 210, the counter-torque is altered. The counter-torque is greatest when the weight arm 210 is farthest from the end where the connecting arm 200 is rotatably connected to the body 100, and gradually decreases as the weight arm 210 moves closer to the end where the connecting arm 200 is rotatably connected to the body 100. Leveraging the principle of leverage to dynamically adjust the counter-torque of the weight arm 210 enables continuous switching between different resistance intensities without adding or removing weight plates.

As shown in FIG. 3, in this embodiment, a plurality of first clamping parts are clamping grooves 202 arranged at intervals along the length direction of the connecting arm 200, and the distances from at least two first clamping parts to the rotation point of the swinging mechanism relative to the body 100 differ. The number of clamping grooves 202 is not specifically limited and can be set according to actual needs-three in this embodiment. The second clamping part is a clamping post 211 located on the weight arm 210, which can be detachably engaged with the clamping groove 202. When a user or automated mechanism needs to adjust the position of the weight arm 210, the clamping post 211 can be quickly disengaged from the clamping groove 202, allowing the weight arm 210 to slide along the orientation part. Upon reaching a new preset position, the clamping post 211 can be reinserted into the corresponding clamping groove 202 to lock the weight arm 210 in place.

As shown in FIGS. 1 to 3, in this embodiment, the orientation part is a guide sliding rod 201 fixed to the connecting arm 200. The weight arm 210 is slidably connected to the guide sliding rod 201, enabling it to reciprocate along the rod. To facilitate the disengagement of the clamping post 211 from the clamping groove 202, the weight arm 210 can also rotate within a limited range around the axial direction of the guide sliding rod 201. The weight arm 210 has a first rotation direction and a second rotation direction, which are opposite to each other—the first rotation direction being upward and the second rotation direction downward. When the weight arm 210 rotates in the first direction relative to the guide sliding rod 201, the clamping post 211 is disengaged from the clamping groove 202, allowing the weight arm 210 to slide reciprocally along the length of the guide sliding rod 201 to adjust its counter-torque. When the weight arm 210 rotates in the second direction relative to the guide sliding rod 201, the clamping post 211 moves closer to the clamping groove 202, the clamping post 211 is inserted into the corresponding clamping groove 202 to form engagement again and lock it in a desired position, preventing sliding of the weight arm 210.

Figure 9:
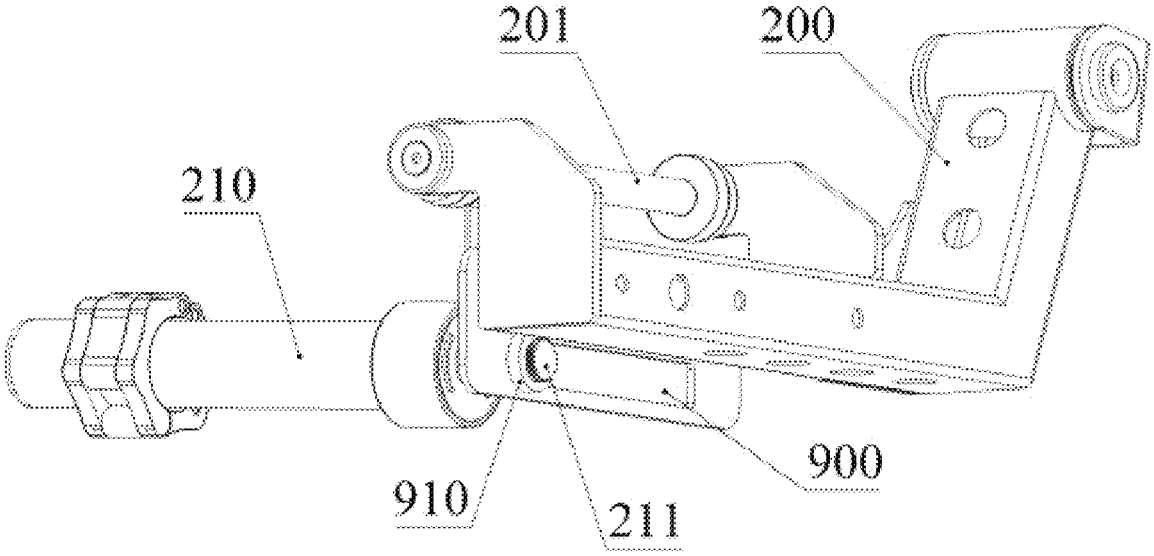
FIG. 9 is a schematic structural view of another embodiment of the weight assembly of the disclosure.

Referring to FIG. 9, in another embodiment of the present disclosure, the first clamping part is a through slot 900 arranged along the length direction of the connecting arm 200. The second clamping part includes a clamping post 211 and a locking member 910. One end of the clamping post 211 is connected to the weight arm 210, while the other end passes through the through slot 900. The clamping post 211 can slide back and forth within the through slot 900 and provides guidance for the weight arm 210, ensuring its smoother sliding. The locking member 910 is movably sleeved on the end of the clamping post 211 away from the weight arm 210. The locking member 910 can be rotationally connected to the clamping post 211 through threaded engagement or clamping. By rotating, the locking member 910 can either abut against or separate from the inner wall of the through slot 900 on the side away from the weight arm 210. When the clamping post 211 slides along the length direction of the through slot 900 to a predetermined position. By rotating, the locking member 910 can tightly abut against the inner wall of the through slot 900 on the side away from the weight arm 210, preventing the weight arm 210 from sliding and thereby achieving a stable locked state. Conversely, when adjustment or repositioning of the weight arm 210 is needed, it simply needs to rotate the locking member 910 in the opposite direction to disengage it from contact with the inner wall of the through slot 900, releasing the locked state of the clamping post 211. At this point, the clamping post 211 can slide freely within the through slot 900, allowing the user to adjust it to a new predetermined position. Subsequently, the locking member 910 is rotated again to tightly abut against the inner wall of the through slot 900 on the side away from the weight arm 210, thus achieving relocking.

In other embodiments (not shown), the connection between the orientation part and the weight arm 210 can also be designed as a sliding groove structure, gear structure, or lead screw structure. When using a sliding groove structure, the orientation part is configured as a sliding groove, and the weight arm 210 is installed within it to achieve a sliding connection. For a gear structure, the orientation part is designed as a straight rack, while a gear is mounted on the weight arm 210, eliminating the clamping structure. The position of the weight arm 210 is adjusted by rotating the gear. In the case of a lead screw structure, the orientation part is configured as a lead screw, and a lead screw nut is installed on the weight arm 210. The position of the weight arm 210 is adjusted by rotating the lead screw.

Refer to FIGS. 1 to 3. In this embodiment, when adjusting the position of the weight arm 210, the user only needs to rotate the weight arm 210 upward, causing the clamping post 211 to disengage from the current clamping groove 202. At this point, the clamping state of the weight arm 210 is released. With the clamping post 211 disengaged from the clamping groove 202, the weight arm 210 can slide freely back and forth along the guide sliding rod 201, thereby altering the magnitude of the counter-torque generated by the weight arm 210. The user can push or pull the weight arm 210 to slide it to the desired position. Once the weight arm 210 reaches the new target position, the user simply lowers the weight arm 210, and the weight arm 210 will automatically descend under gravity, causing the clamping post 211 to be re-engaged with the corresponding clamping groove 202. At this point, the weight arm 210 is relocked to be restricted from sliding and secured in the new position.

Figure 4:
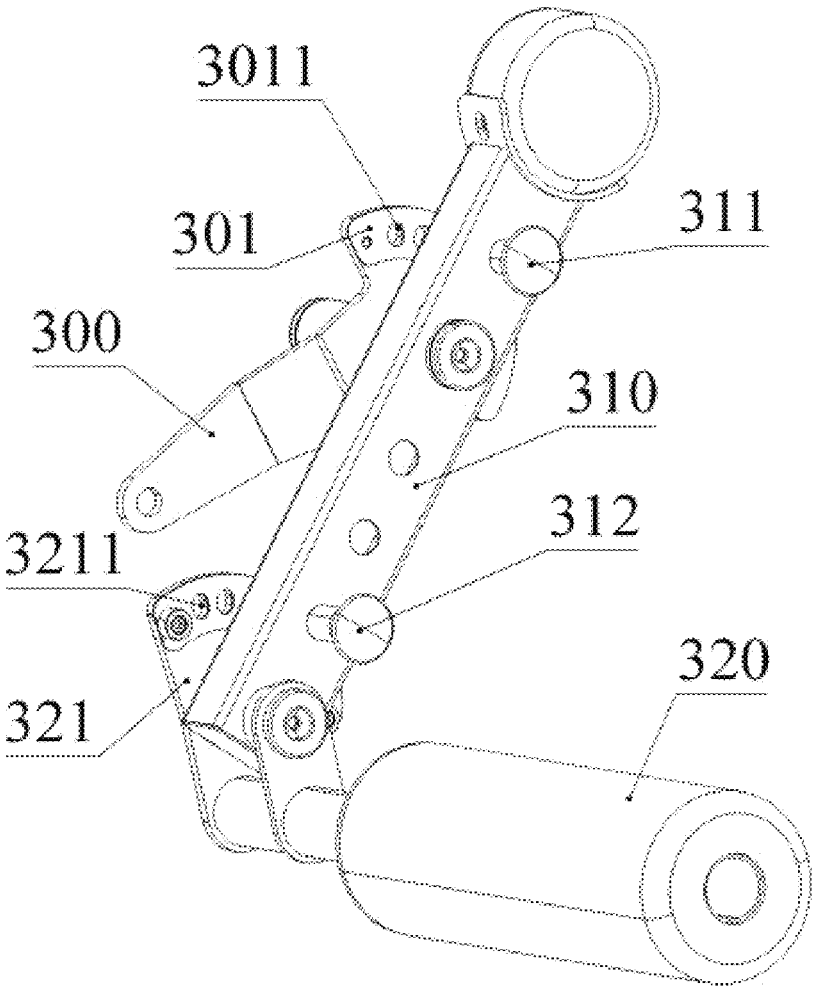
FIG. 4 is a schematic structural view of the swinging assembly of the disclosure.
Figure 5:
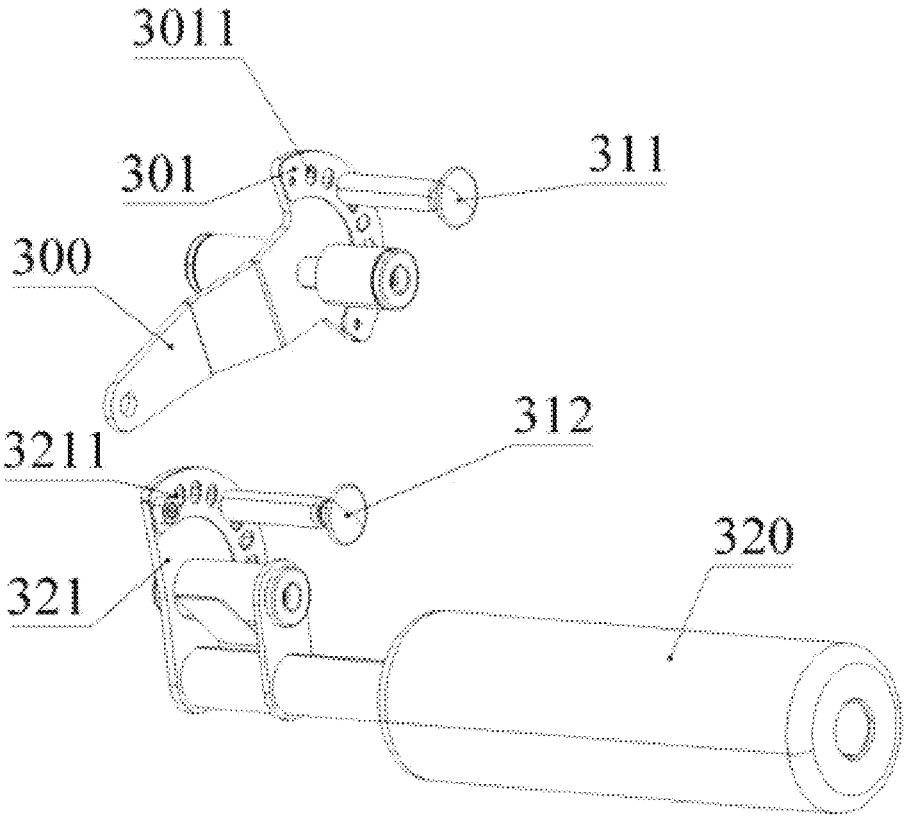
FIG. 5 is a schematic structural view of the adjustment mechanism of the disclosure.

Refer to FIGS. 2, 4, and 5. In this embodiment, the swinging mechanism includes a swing crossbar 320, a first link rod 300 and a second link rod 310. The first link rod 300 is rotationally connected to one end of the second link rod 310 and pivoted on the body 100, while the other end of the second link rod 310 is rotationally connected to the swing crossbar 320. Through the coordination of a plurality of link rods and pivot points, the linkage for leg flexion and extension during training is achieved. A first adjustment mechanism is provided between the first link rod 300 and the second link rod 310, allowing the angle between the first link rod 300 and the second link rod 310 to be adjusted through the first adjustment mechanism. A second adjustment mechanism is set between the swing crossbar 320 and the second link rod 310, enabling the angle between the swing crossbar 320 and the second link rod 310 to be adjusted through the second adjustment mechanism. Users can adjust the angles between the first link rod 300 and the second link rod 310, as well as between the swing crossbar 320 and the second link rod 310, according to training needs, achieving the desired angle settings for different movements and accommodating users of varying body types to meet personalized training requirements.

Referring to FIGS. 4 and 5, in this embodiment, the first adjustment structure includes a first adjustment disc 301 mounted on the first link rod 300 and a first gear lever 311 mounted on the second link rod 310. The first adjustment disc 301 is provided with a plurality of first insertion holes 3011, which are evenly distributed along the circumference of the first adjustment disc 301. The first gear lever 311 can be detachably inserted into the first insertion holes 3011 to adjust the angle between the first link rod 300 and the second link rod 310. The second adjustment mechanism includes a second adjustment disc 321 mounted on the swing crossbar 320 and a second gear lever 312 mounted on the second link rod 310. The second adjustment disc 321 is provided with a plurality of second insertion holes 3211, which are evenly distributed along the circumference of the second adjustment disc 321. The second gear lever 312 can be detachably inserted into the second insertion holes 3211. By selecting different positions of the second insertion holes 3211, the angle between the swing crossbar 320 and the second link rod 310 can be adjusted. Through the flexible adjustment of the insertion structure, users can quickly adjust the angle according to different training movements and needs to accommodate various training requirements. The number of first insertion holes 3011 and second insertion holes 3211 is not specifically limited and can be designed based on actual needs; in this embodiment, there are 7 of each.

Referring to FIGS. 2, 4, and 5, in this embodiment, the first gear lever 311 can be inserted into any first insertion hole 3011 to restrict the rotation of the first link rod 300 relative to the second link rod 310. The second gear lever 312 can be inserted into any second insertion hole 3211 to restrict the rotation of the swing crossbar 320 relative to the second link rod 310. By limiting their relative rotation, a fixed angle is ensured, forming a linkage. At this point, the first link rod 300, the second link rod 310 and the swing crossbar 320 form a linkage mechanism. When the user lifts the swing crossbar 320 upward, the second link rod 310 drives the first link rod 300 to swing upward relative to the body 100 around the pivot point. A traction rod 400 is also arranged between the connecting arm 200 and the first link rod 300. One end of the traction rod 400 is rotatably connected to the connecting arm 200, and the other end is rotatably connected to the first link rod 300. Through the traction rod 400, the connecting arm 200 is linked to rotate upward relative to the body 100. The user must overcome the counter-torque generated by the gravity of the weight arm 210 to complete the movement. When the user finishes the movement and relaxes, the weight arm 210 drives the connecting arm 200 to descend under gravity, and the traction rod will bring the swinging mechanism back to its original position, achieving automatic reset after the training movement.

Figure 6:
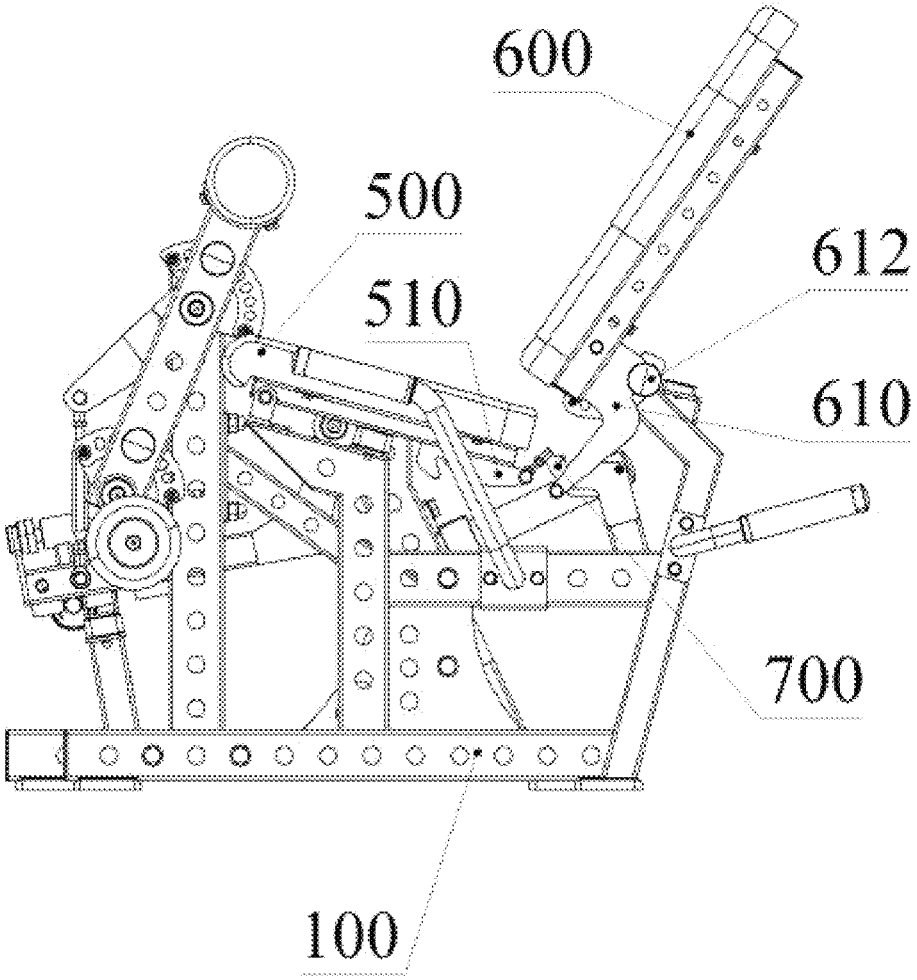
FIG. 6 is a schematic state view of seated leg extension and flexion of the disclosure.
Figure 7:
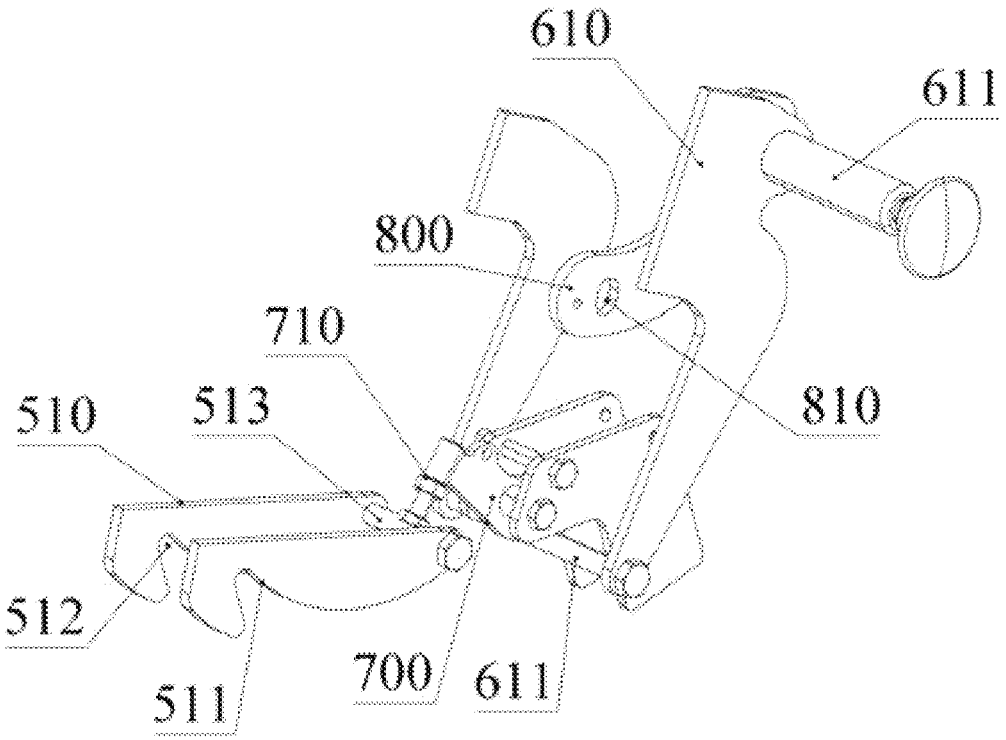
FIG. 7 is a schematic structural view of the linkage between the seat cushion and back cushion of the disclosure.
Figure 8:
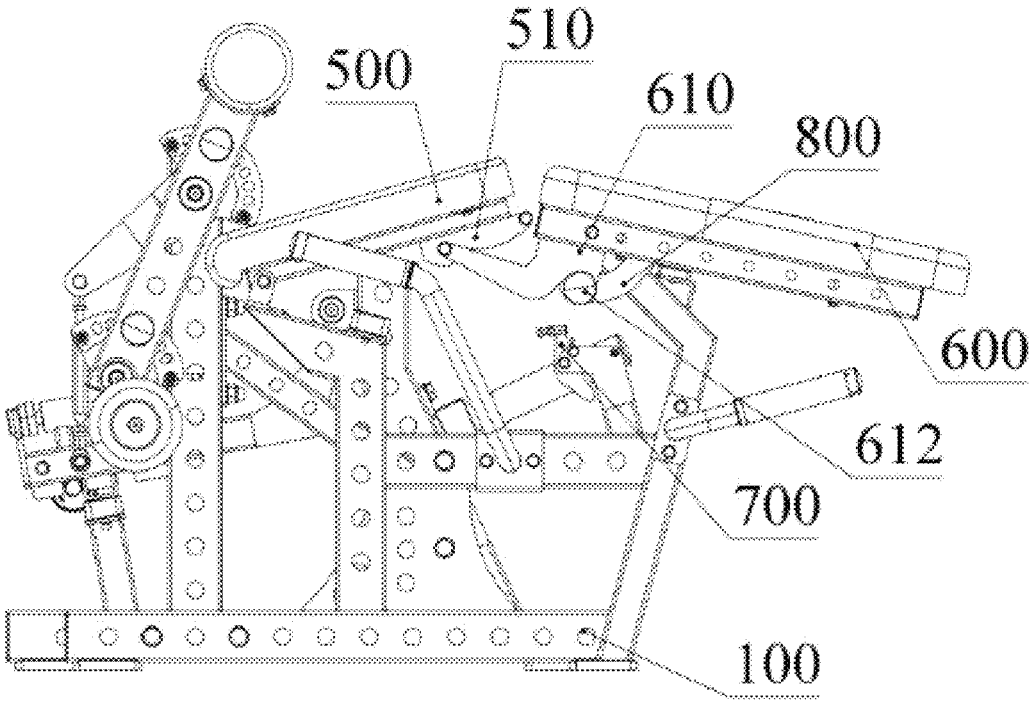
FIG. 8 is a schematic state view of prone leg extension and flexion of the disclosure.

Please refer to FIGS. 6 to 8. In this embodiment, the body 100 is also rotationally connected with a seat cushion 500 and a back cushion 600, allowing users to easily adjust their sitting or reclining postures for a more comfortable training experience. The bottom of the seat cushion 500 is provided with a guide part 510, which includes an arc-shaped guiding surface 511, a positioning groove 512 and a connecting rod 513. The bottom of the back cushion 600 is provided with a lever part 610, which features a lever 611 that rotates with the back cushion 600. The body 100 is also rotationally connected with a stop member 700. One end of the stop member 700, adjacent to the orientation part, is fitted with a pressing block 710. Additionally, a return spring is connected between the stop member 700 and the body 100, with one end attached to the body 100 and the other end connected to the stop member 700 adjacent to the pressing block 710.

Referring to FIGS. 7 and 8, in this embodiment, the end of the lever part 610 away from the lever 611 is also provided with a first locking pin 612. The body 100 is provided with a first locking plate 800, and both ends of the first locking plate 800 are provided with first locking holes 810. The first locking pin 612 can be detachably inserted into one of the first locking holes 810 to adjust the angle of the back cushion 600. When the back cushion 600 is rotated away from the seat point, the lever 611 rotates upward and abuts against the arc-shaped guiding surface 511, sliding along it to enter the positioning groove 512. This process pushes the seat cushion 500 to rotate. When the lever 611 rotates downward, it disengages from the positioning groove 512 and abuts against the stop member 700, driving the stop member 700 to rotate and bringing the pressing block 710 closer to the connecting rod 513. The seat cushion 500 returns to its original position under gravity, and the pressing block 710 abuts against the link rod to restrict the rotation of the seat cushion 500.

Figure 10:
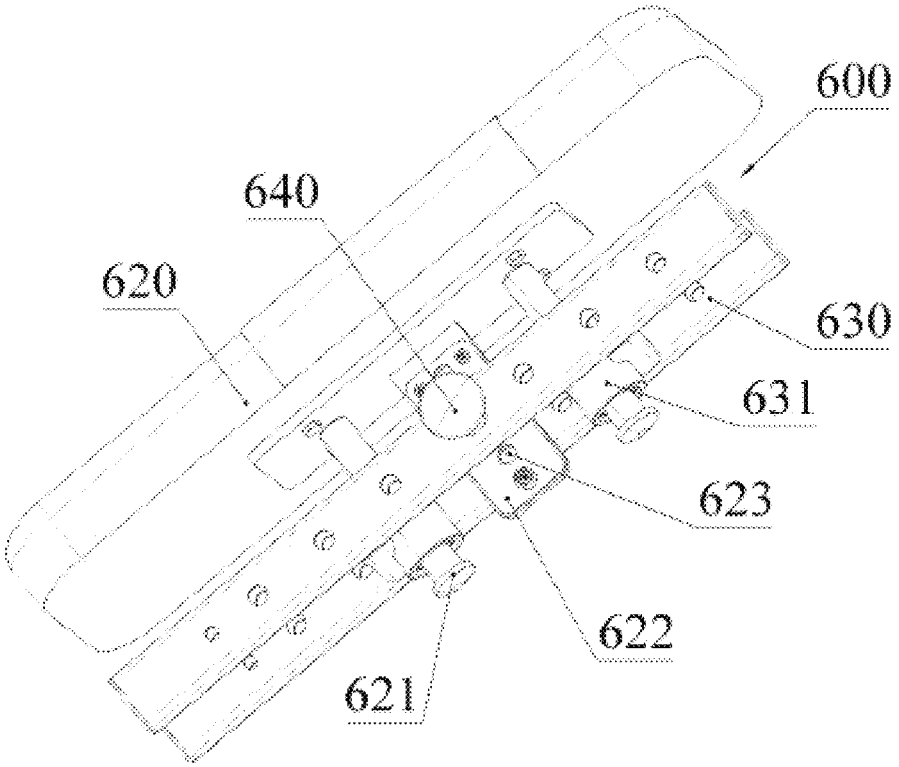
FIG. 10 is a schematic structural view of another embodiment of the back cushion of the disclosure.
Figure 11:
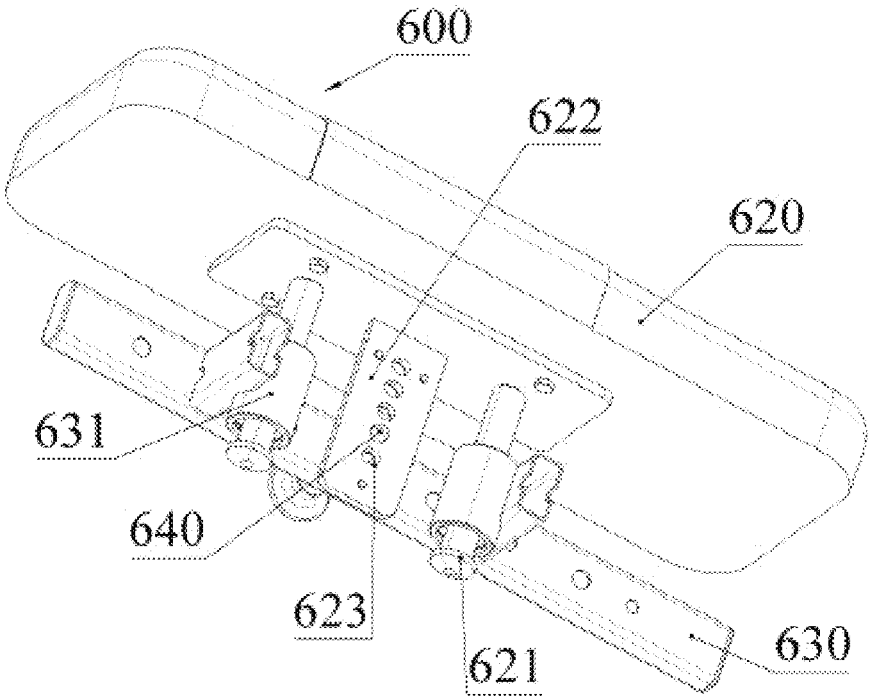
FIG. 11 is a schematic state view of another embodiment of the back cushion of the disclosure.
Figure 12:
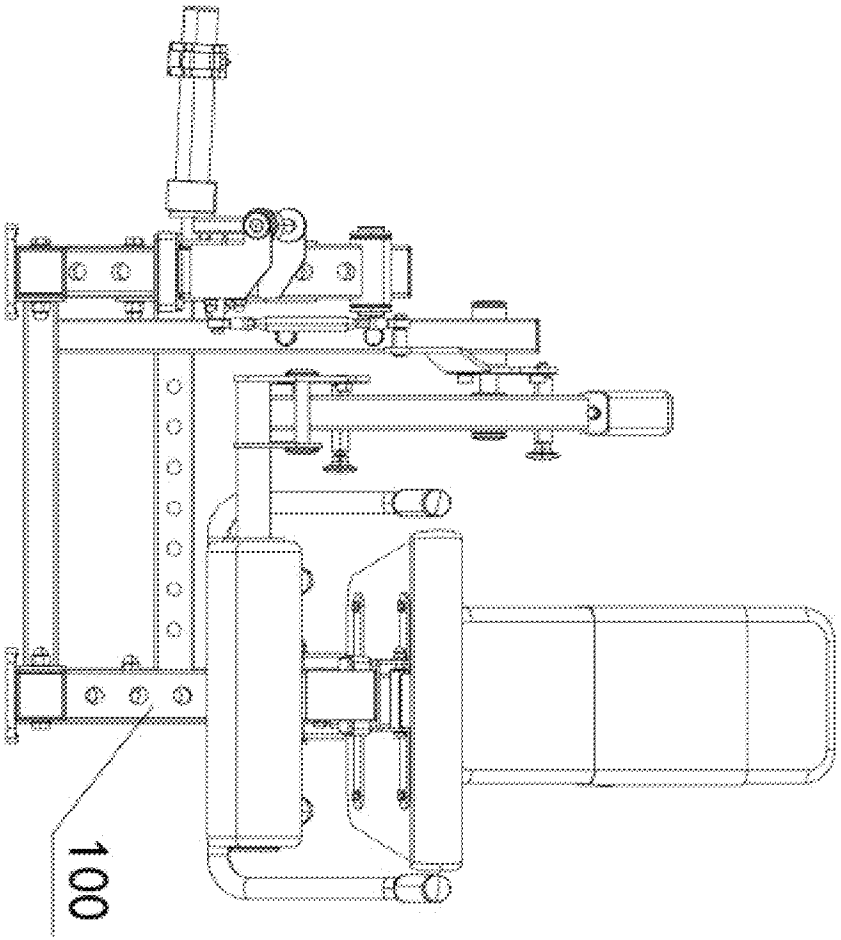
FIG. 12 is a front view of another embodiment of the present disclosure.
Figure 13:
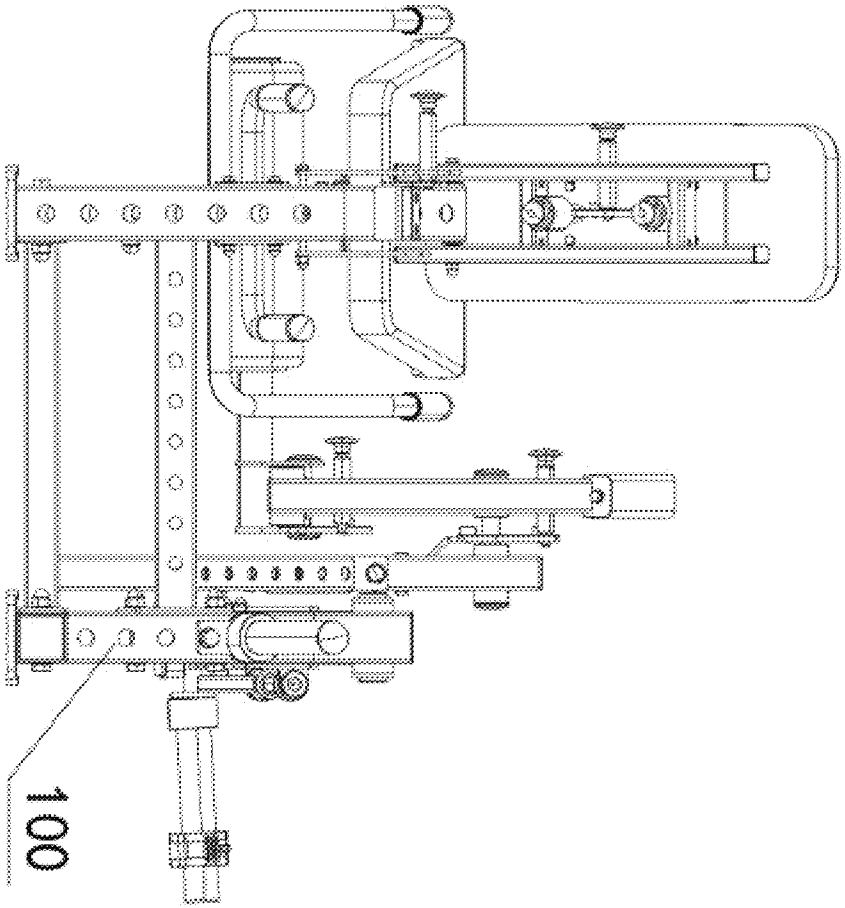
FIG. 13 is a rear view of another embodiment of the present disclosure.
Figure 14:
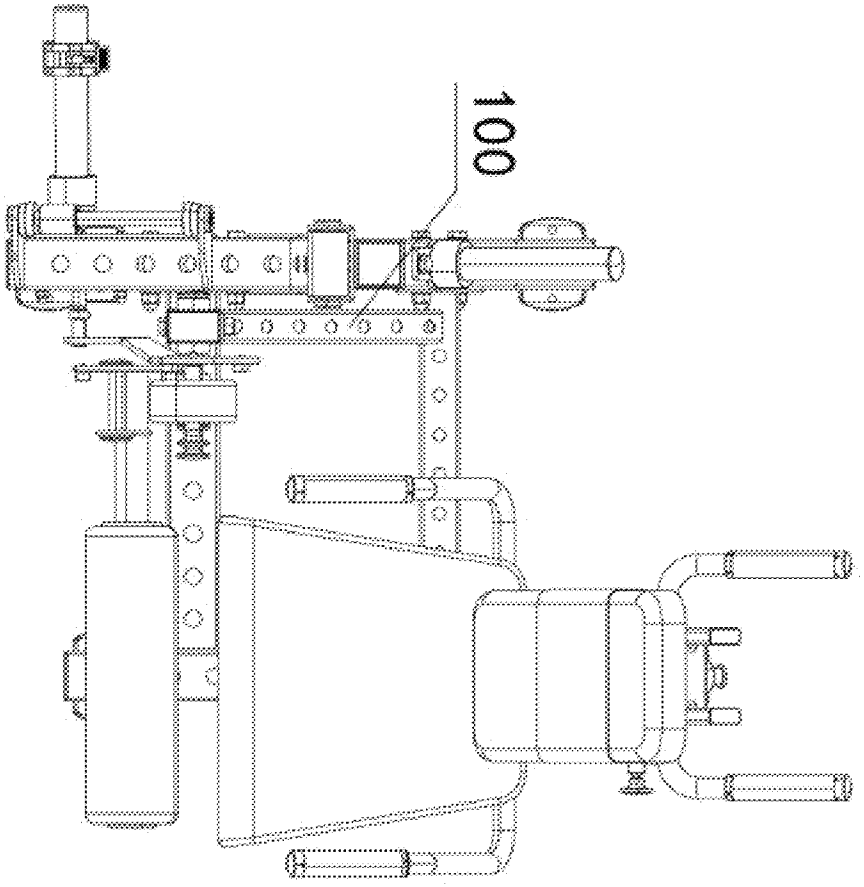
FIG. 14 is a top view of another embodiment of the present disclosure.
Figure 15:
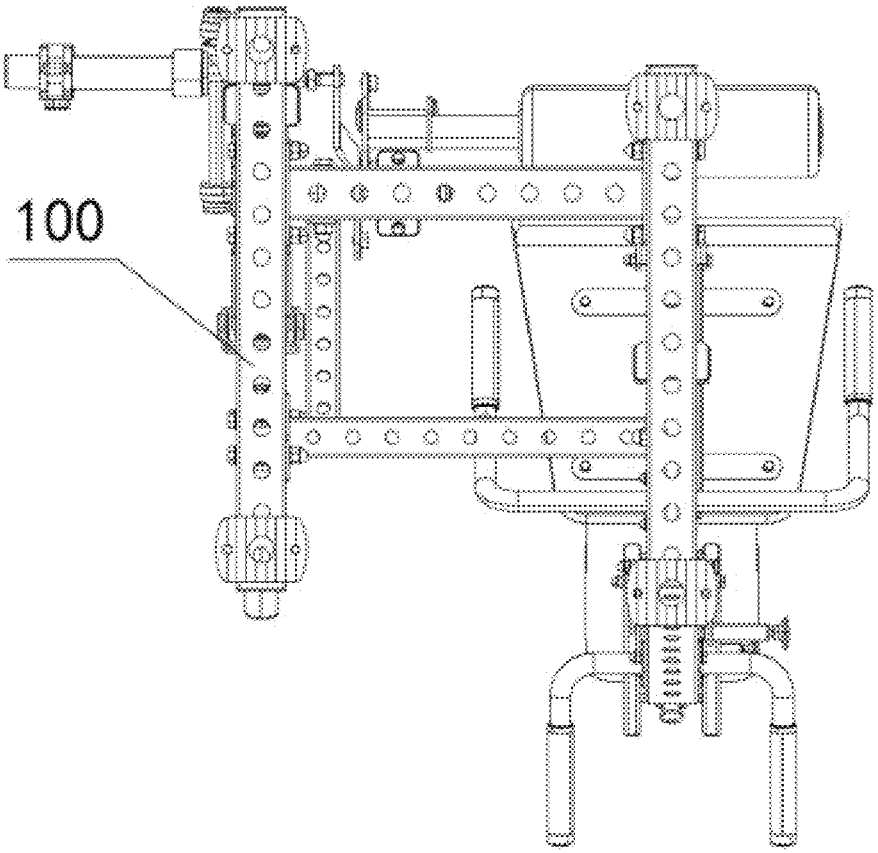
FIG. 15 is a bottom view of another embodiment of the present disclosure.
Figure 16:
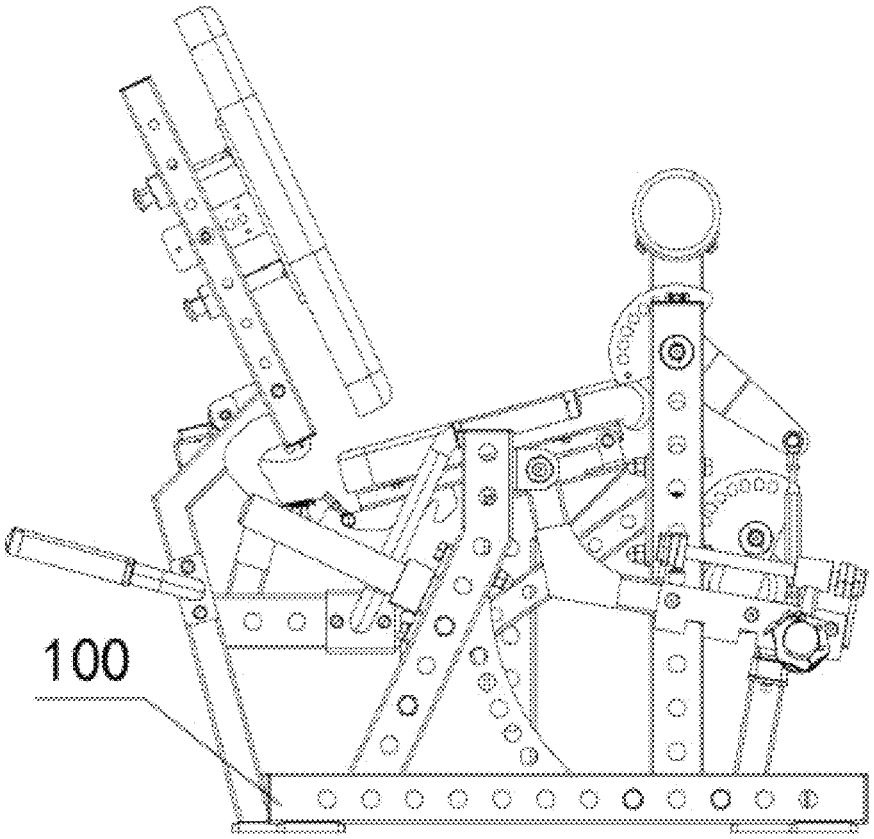
FIG. 16 is a left view of another embodiment of the present disclosure.
Figure 17:
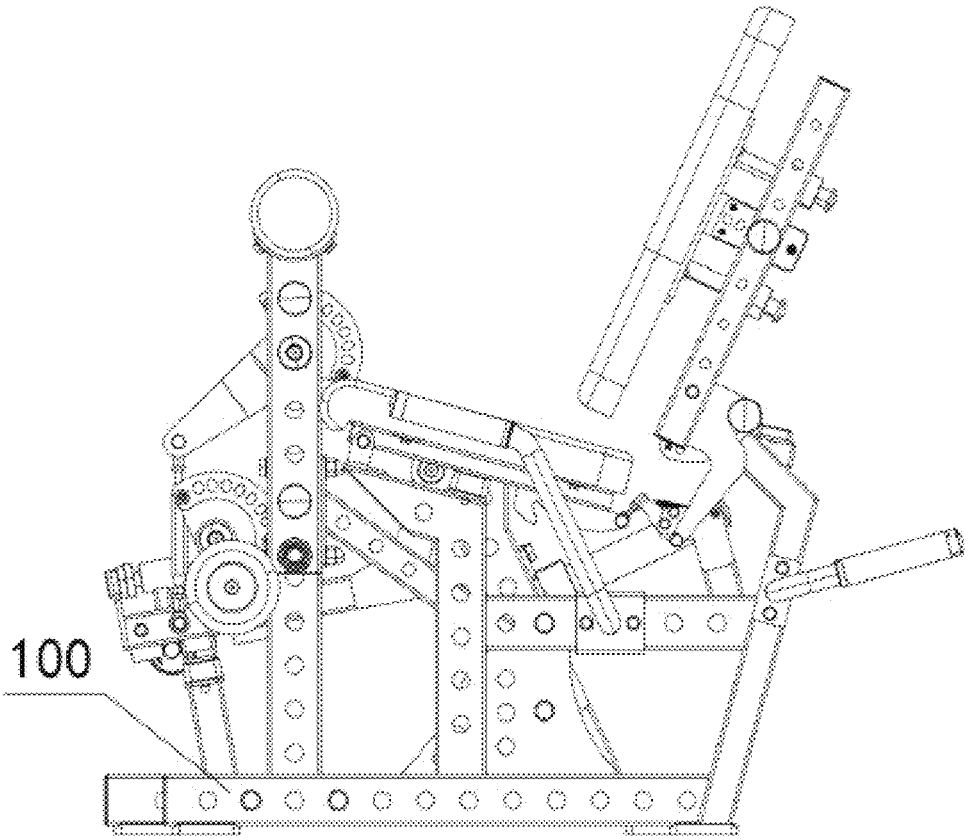
FIG. 17 is a right view of another embodiment of the present disclosure.
Figure 18:
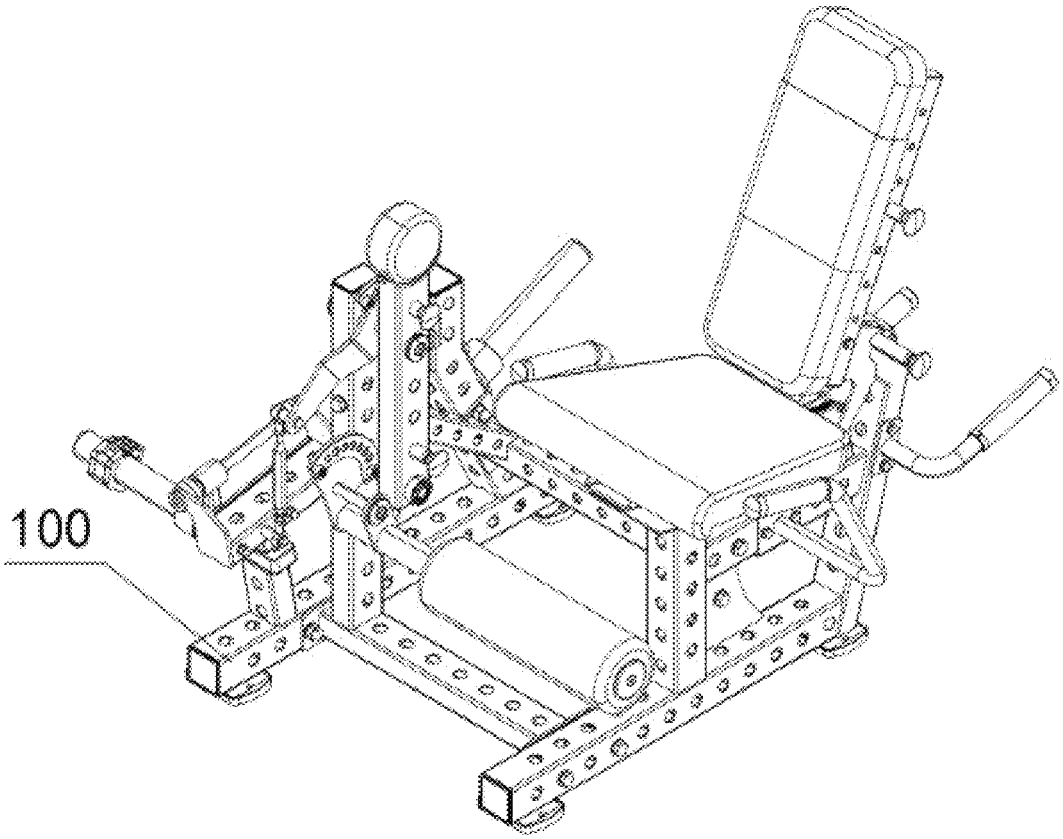
FIG. 18 is an isometric view of another embodiment of the present disclosure.

Referring to FIGS. 10 and 11, in this embodiment, the back cushion 600 includes a cushion body 620 and a bracket 630. The side of the cushion body 620 adjacent to the bracket 630 is provided with a sliding rod 621 and a positioning member 622. The positioning member 622 has a plurality of second locking holes 623 along its length. The bracket 630 is provided with a mounting base 631, and the sliding rod 621 is sleeved within the mounting base 631, allowing reciprocating motion to adjust the position of the cushion body 620 relative to the bracket 630. One side of the bracket 630 is also provided with a second locking pin 640, which can be selectively and detachably inserted into any second locking hole 623 to secure the cushion body 620. When adjusting the position of the cushion body 620, the user only needs to pull the second locking pin 640 out of the second locking hole 623, placing the cushion body 620 in an unlocked state. Once the cushion body 620 is moved to the desired position, the second locking pin 640 is inserted into the corresponding second locking hole 623 to firmly lock the cushion body 620, preventing accidental sliding during training. Based on individual height, body type, and training experience, users can quickly adjust the position of the cushion body 620 in seated leg extension mode to optimize leg exertion angles, enhancing training comfort and exercise effectiveness.

Please refer to FIGS. 6 to 8. In this embodiment, the all-in-one machine for leg extension and flexion has two training modes: seated leg extension and prone leg extension. When the machine is in the seated leg extension mode, the back cushion 600 is inserted into the first locking hole 810 at the upper end of the first locking plate 800 through the first locking pin 612, thereby restricting the rotation of the back cushion 600 and preventing instability during training due to its movement. At this time, the lever 611 abuts against the stop member 700, the return spring is stretched, and the pressing block 710 tightly presses against the connecting rod 513, effectively preventing unnecessary rotation of the seat cushion 500 during use. This ensures the seat cushion 500 maintains a predetermined angle during training, guaranteeing user safety. When switching to the prone leg extension mode, first pull the first locking pin 612 out of the first locking hole 810 to unlock the back cushion 600, allowing the back cushion 600 to rotate. The back cushion 600 is rotated away from the seat cushion 500, causing the lever 611 to gradually approach and abut against the arc-shaped guiding surface 511. It then slides along the arc-shaped guiding surface 511 until it enters the positioning groove 512. During this process, the pressing block 710 gradually moves away from the connecting rod 513 under the action of the return spring, enabling the lever 611 to drive the seat cushion 500 to rotate upward as it slides along the arc-shaped guiding surface 511, adjusting the angle of the seat cushion 500. Once the lever 611 is engaged with the positioning groove 512, the first locking pin 612 is inserted into the first locking hole 810 adjacent to the lower end of the first locking plate 800 to restrict the rotation of the back cushion 600, ensuring the stability of the back cushion 600 during prone training. Additionally, after the lever 611 is engaged with the positioning groove 512, its restriction on the rotation of the seat cushion 500 fixes the entire seat cushion 500 at a preset angle, ensuring stability throughout the training process.

In other embodiments (not shown), the orientation part is replaced with a straight-tooth rack installed on the top surface of the connecting arm 200 (instead of the original guide sliding rod 201). A gearbox is mounted at the bottom of the weight arm 210, containing a transmission gear that meshes with the rack. The side wall of the gearbox is provided with a spring latch, and the rack has evenly spaced positioning holes along its length. When the gear rotation drives the weight arm 210 to slide to the target position, the spring latch automatically snaps into the corresponding positioning hole to achieve locking. By lifting the ring handle at the end of the weight arm 210, the user retracts the spring latch synchronously through the link rod mechanism, disengaging it from the rack. At this point, rotating the handle drives the gear to turn, enabling precise movement of the weight arm 210. Gear transmission allows millimeter-level fine-tuning with more linear resistance changes; the one-handed operation mode (lift+rotate) improves efficiency; the spring latch and positioning holes provide mechanical interlocking with strong impact resistance.

In other embodiments (not shown), the connecting arm 200 is embedded with linear guide rails, and the weight arm 210 is slidably connected through sliders. An array of electromagnets is embedded on the side of the guide rails, with ferromagnetic plates installed at corresponding positions on the weight arm 210. When powered, the electromagnets attract the ferromagnetic plates for instant locking; when unpowered, the weight arm 210 slides freely. The body 100 is provided with a touchscreen. After the user selects a resistance level, the controller automatically calculates the target position and controls the electromagnets' power state, coordinating with a servo motor to drive the weight arm 210 for precise movement. Physical clamping structures are entirely eliminated, enabling fully automatic stepless adjustment; preset programs support memorizing common resistance curves (e.g., progressive resistance increase); electromagnetic response time is <0.1 seconds, allowing real-time dynamic resistance adjustments during training.

In other embodiments (not shown), the weight arm 210 contains a hydraulic chamber filled with magnetorheological fluid, with the piston rod fixed to the rotating axis of the connecting arm 200. The guide sliding rod 201 and clamping groove 202 structures are retained for basic gear locking. The piston rod has an embedded electromagnetic coil that adjusts the viscosity of the magnetorheological fluid by varying current intensity, providing an additional 0-30% fine-tuned resistance on top of the fixed position. The user controls the current intensity through a knob, with the LCD screen displaying the current composite resistance value in real time. Mechanical positioning ensures safety under heavy loads, while the hydraulic system enables precise resistance compensation; continuous adjustment within a single gear avoids frequent switching of clamping positions; the magnetorheological fluid responds rapidly (millisecond-level), making it suitable for explosive power training scenarios.

In other embodiments (not shown in the drawings), the straight weight arm 210 is replaced with a rotatable eccentric wheel, whose shaft is slidably connected to the connecting arm 200. A counterweight block is arranged at the edge of the eccentric wheel, and the shaft is connected to a stepper motor. When the user lifts their leg, the sensor detects the swing angle, and the controller drives the motor to rotate the eccentric wheel, ensuring the counterweight block always remains in the position that maximizes the gravitational torque. The connecting arm 200 is provided with an arc-shaped sliding groove, and the pneumatic lock at the bottom of the shaft automatically secures the current position when power is off. Technical effects: The eccentric wheel structure expands the resistance range by 40% under the same weight; it dynamically optimizes the direction of the counterweight torque, eliminating dead points in motion; it is suitable for asymmetric resistance modes in rehabilitation training (e.g., strengthening only the eccentric contraction phase).

In summary, as can be seen from the above description, the present disclosure achieves the following technical effects: By arranging the guide sliding rod 201 on the connecting arm 200, the weight arm 210 can slide back and forth along the guide sliding rod 201, dynamically adjusting the counter-torque of the weight arm 210 using the lever principle. When the weight arm 210 moves away from the rotating connection end between the connecting arm 200 and the body 100, the counter-torque is maximized, and it gradually decreases otherwise, enabling continuous switching of different resistance intensities. Users can precisely adjust training resistance without adding or removing weight plates; the snap-fit structure between the weight arm 210 and the connecting arm 200 allows multi-gear fixed adjustments. Users only need to rotate the weight arm 210 to quickly unlock/lock it, ensuring convenient operation and high stability, preventing accidental sliding during exercise and improving training efficiency.

In the description of the present disclosure, it should be appreciated that directional terms such as "front, rear, up, down, left, right", "horizontal, vertical, perpendicular, horizontal" and "top, bottom" etc. indicate the orientation or positional relationship based on the orientation or positional relationship shown in the drawings, and are only for the convenience of describing the present disclosure and simplifying the description. In the absence of a contrary explanation, these directional terms do not indicate or imply that the device or element referred to must have a specific orientation or be constructed and operated in a specific orientation, and therefore should not be understood as limiting the scope of protection of the present disclosure; the directional terms "inside, outside" refer to the inside and outside relative to the contour of each component itself.

For the convenience of description, spatial relative terms such as "on . . . ", "above . . . ", "on the upper surface of . . . ", "upper" etc. may be used here to describe the spatial positional relationship of a device or feature with other devices or features as shown in the drawings. It should be appreciated that spatial relative terms are intended to encompass different orientations of the device in use or operation other than the orientation described in the drawings. For example, if the device in the drawing is inverted, the device described as "above other devices or structures" or "on other devices or structures" will subsequently be positioned as "below other devices or structures" or "under other devices or structures". Thus, the exemplary term "above" can include both "above" and "below" orientations. The device can also be positioned in other different ways (rotated 90 degrees or in other orientations), and the spatial relative descriptions used here should be interpreted accordingly.

In addition, it should be noted that the use of terms such as "first", "second" etc. to define components is for the convenience of distinguishing the corresponding components. Unless otherwise stated, the above terms have no special meaning, and therefore should not be understood as limiting the scope of protection of the present disclosure.

The above description is only a preferred embodiment of the present disclosure and is not intended to limit the present disclosure. For those skilled in the art, the present disclosure can have various modifications and changes. Any modifications, equivalent replacements, improvements etc. made within the spirit and principles of the present disclosure should be included within the scope of protection of the present disclosure.

What is claimed is:

1. An all-in-one machine for leg extension and flexion, comprising:

a body;

a swinging mechanism, mounted on the body; and a weight assembly, mounted on the body and operably linked with the swinging mechanism;

wherein the weight assembly comprises a connecting arm rotationally connected to the body, the connecting arm is provided with an orientation part along a length direction thereof, and a weight arm is mounted on the orientation part, wherein the weight arm is capable of reciprocally sliding along the orientation part and rotating the around the orientation part, the connecting arm is provided with a plurality of first clamping parts, and the weight arm is provided with a second clamping part matching the plurality of first clamping parts, and wherein the second clamping part is selectively engaged with any of the plurality of first clamping parts to restrict sliding of the weight arm.

2. The all-in-one machine for leg extension and flexion according to claim 1, wherein the plurality of first clamping parts are clamping grooves arranged along the length direction of the connecting arm, the second clamping part is a clamping post mounted on the weight arm, and the clamping post is capable of being detachably engaged with the clamping grooves.

3. The all-in-one machine for leg extension and flexion according to claim 2, wherein the orientation part is a guide sliding rod, and the weight arm is slidably connected to the guide sliding rod.

4. The all-in-one machine for leg extension and flexion according to claim 3, wherein the weight arm has a first rotation direction and a second rotation direction, and when the weight arm rotates relative to the guide sliding rod in the first rotation direction, the clamping post disengages from the clamping grooves, allowing the weight arm to reciprocally slide along a length direction of the guide sliding rod;

wherein when the weight arm rotates relative to the guide sliding rod in the second rotation direction, the clamping post approaches and is engaged with one of the clamping grooves, restricting the weight arm from sliding along the length direction of the guide sliding rod; and wherein the first rotation direction and the second rotation direction are opposite to each other.

5. The all-in-one machine for leg extension and flexion according to claim 1, wherein the swinging mechanism comprises a swing crossbar, a first link rod and a second link rod, and wherein the first link rod is rotationally connected to one end of the second link rod and pivoted on the body, and another end of the second link rod is rotationally connected to the swing crossbar.

6. The all-in-one machine for leg extension and flexion according to claim 5, wherein a first adjustment mechanism is provided between the first link rod and the second link rod for adjusting an angle between the first link rod and the second link rod; and/or a second adjustment mechanism is provided between the swing crossbar and the second link rod for adjusting an angle between the swing crossbar and the second link rod.

7. The all-in-one machine for leg extension and flexion according to claim 6, wherein the first adjustment mechanism comprises a first adjustment disc arranged on the first link rod and a first gear lever arranged on the second link rod, wherein the first adjustment disc is provided with a plurality of first insertion holes uniformly distributed along a circumference thereof, and the first gear lever is capable of being detachably inserted into the plurality of first insertion holes; and the second adjustment mechanism comprises a second adjustment disc arranged on the swing crossbar and a second gear lever arranged on the second link rod, wherein the second adjustment disc is provided with a plurality of second insertion holes distributed along a circumference thereof, and the second gear lever is capable of being detachably inserted into the plurality of second insertion holes.

8. The all-in-one machine for leg extension and flexion according to claim 7, wherein the first gear lever is capable of being inserted into any first insertion hole to restrict rotation of the first link rod relative to the second link rod; and the second gear lever is capable of being inserted into any second insertion hole to restrict rotation of the swing crossbar relative to the second link rod.

9. The all-in-one machine for leg extension and flexion according to claim 5, wherein a traction rod is further arranged between the connecting arm and the first link rod, with one end of the traction rod rotationally connected to the connecting arm and another end of the traction rod rotationally connected to the first link rod.

10. The all-in-one machine for leg extension and flexion according to claim 1, further comprising a seat cushion and a back cushion respectively rotationally mounted on the body, the back cushion driving rotation of the seat cushion when rotating, wherein the back cushion comprises a bracket and a cushion body mounted on the bracket, and the cushion body is capable of reciprocating relative to the bracket.

11. The all-in-one machine for leg extension and flexion according to claim 10, wherein a side of the cushion body adjacent to the bracket is provided with a sliding rod and a positioning member, with a plurality of second locking holes provided along a length of the positioning member;

wherein the bracket is provided with a mounting base, the sliding rod is installed in the mounting base and can reciprocate within it, thereby adjusting a position of the cushion body; and wherein the bracket is further provided with a second locking pin capable of being selectively and detachably engaged with any second locking hole to place the cushion body in an unlocked state or a locked state.

12. The all-in-one machine for leg extension and flexion according to claim 1, wherein the plurality of first clamping parts are spaced apart, and at least two first clamping parts are at different distances from a rotation point of the swinging mechanism relative to the body.

13. An all-in-one machine for leg extension and flexion comprises a body and a swinging mechanism, wherein:

the body is provided with a weight assembly that is operably linked to the swinging mechanism;

the weight assembly comprises a connecting arm rotationally connected to the body, the connecting arm is provided with an orientation part arranged along a length direction thereof, and the orientation part is equipped with a weight arm capable of sliding reciprocally along the orientation part; and the connecting arm is provided with a plurality of first clamping parts, the weight arm is provided with a second clamping part matching the plurality of first clamping parts, and the second clamping part is capable of being selectively engaged with any of the plurality of first clamping parts to restrict sliding of the weight arm.

14. The all-in-one machine for leg extension and flexion according to claim 13, wherein the plurality of first clamping parts are clamping grooves spaced along the length direction of the connecting arm, the second clamping part is a clamping post mounted on the weight arm, and the clamping post is capable of being detachably engaged with the clamping grooves.

15. The all-in-one machine for leg extension and flexion according to claim 14, wherein the orientation part is a guide sliding rod, and the weight arm is slidably connected to the guide sliding rod and is rotatable relative to the guide sliding rod.

16. The all-in-one machine for leg extension and flexion according to claim 15, wherein when the weight arm rotates relative to the guide sliding rod, the clamping post disengages from the clamping grooves, allowing the weight arm to slide reciprocally along the guide sliding rod; and wherein when the clamping post approaches the clamping grooves, the clamping post is engaged with one of the clamping grooves, restricting sliding of the weight arm.

17. The all-in-one machine for leg extension and flexion according to claim 13, wherein the swinging mechanism comprises a swing crossbar, a first link rod and a second link rod, and wherein the first link rod is rotationally connected to one end of the second link rod and pivoted on the body, and another end of the second link rod is rotationally connected to the swing crossbar.

18. The all-in-one machine for leg extension and flexion according to claim 17, wherein a first adjustment mechanism is arranged between the first link rod and the second link rod to adjust an angle between the first link rod and the second link rod; and wherein a second adjustment mechanism is arranged between the swing crossbar and the second link rod to adjust an angle between the swing crossbar and the second link rod.

19. An all-in-one machine for leg extension and flexion, comprising a body and a swinging mechanism, wherein:

the body is provided with a weight assembly that is operably linked to the swinging mechanism;

the weight assembly comprises a connecting arm rotationally connected to the body, the connecting arm is provided with an orientation part arranged along a length direction thereof, and the orientation part is equipped with a weight arm capable of sliding reciprocally along the orientation part; and the connecting arm is provided with a first clamping part, the weight arm is provided with a second clamping part matching the first clamping part, and the second clamping part is capable of being selectively engaged with any position of the first clamping part to achieve locking and restrict sliding of the weight arm.

20. The all-in-one machine for leg extension and flexion according to claim 19, wherein the first clamping part is a through slot arranged along the length direction of the connecting arm, and the second clamping part comprises:

a clamping post, with one end connected to the weight arm and the another end thereof passing through the through slot; and a locking member movably sleeved on an end of the clamping post away from the weight arm;

wherein when the clamping post slides along a length direction of the through slot to a predetermined position, the locking member is rotated to fit against a side of the through slot away from the weight arm, thereby locking a position of the clamping post; and, wherein conversely, by reversely rotating the locking member, the position of the clamping post is unlocked.

* * * * *